United States Patent [19]

Johansen et al.

[11] 4,329,380

[45] May 11, 1982

[54] CONTAINER AND METHOD AND APPARATUS FOR THE COATING OF SAME

[75] Inventors: Aage M. Johansen, Odense, Denmark; Olav A. Ronold, deceased, late of Odense, Denmark, by Ronold Turid, Heir

[73] Assignee: A/S Haustrups Fabriker, Odense, Denmark

[21] Appl. No.: 931,038

[22] Filed: Aug. 4, 1978

Related U.S. Application Data

[63] Continuation-in-part of Ser. No. 683,674, May 5, 1976, abandoned.

[51] Int. Cl.[3] ..... B05D 7/22

[52] U.S. Cl. ..... 427/236; 118/302; 118/315; 118/317; 118/DIG. 3; 118/58; 118/324; 427/230; 427/239; 427/421; 427/422; 427/424; 427/388.1

[58] Field of Search ..... 427/421, 422, 236, 424, 427/427, 239, 410, 230, 388.1; 118/302, 317, 318, 622, DIG. 3, 105, 315, 408, 58, 342; 220/81 R; 239/565

[56] References Cited

U.S. PATENT DOCUMENTS

| | | | |
|---|---|---|---|
| 2,124,853 | 7/1938 | Grupe | 118/317 |
| 2,499,621 | 3/1950 | Archer | 118/317 |
| 2,642,530 | 2/1972 | Webb | 427/410 |
| 2,919,255 | 12/1959 | Hart | 220/81 R |
| 2,934,236 | 4/1960 | Groves | 220/81 R |
| 3,077,171 | 2/1963 | Gotsch et al. | 118/317 |
| 3,081,947 | 3/1963 | Walter | 118/317 |
| 3,526,027 | 9/1970 | Manuel et al. | 118/317 |
| 3,797,456 | 3/1974 | Hogstrom | 118/317 |
| 3,816,165 | 6/1974 | Horvath | 118/317 |
| 3,921,570 | 11/1975 | Hogstrom et al. | 118/317 |
| 3,995,075 | 11/1976 | Cernaukas | 427/236 |

*Primary Examiner*—Norman Morgenstern
*Assistant Examiner*—Janyce Bell
*Attorney, Agent, or Firm*—Charles E. Brown

[57] ABSTRACT

A container wherein exposed surfaces thereof which are particularly subjected to a chemical reaction, such as corrosion, are protected by the application of a thixotropic lacquer. A typical installation is the application of a band of thixotropic lacquer internally of the container along the longitudinal side seam. A thixotropic lacquer has the characteristic that there is very little flow after its application to a surface, and thus is particularly adapted for covering raw edges and like exposed areas of containers. The thixotropic lacquer is applied preferably in plural closely adjacent streams which unite after the lacquer engages the container surface. Beneficial results are obtained by adjusting the temperature of the container and/or lacquer, and further by heating the applied band of lacquer.

12 Claims, 5 Drawing Figures

FIG.1
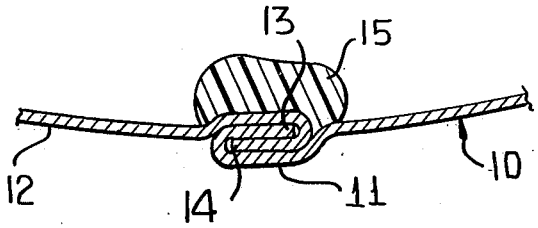
FIG.2
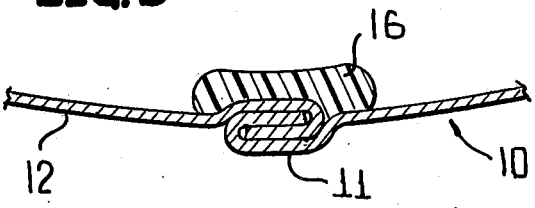
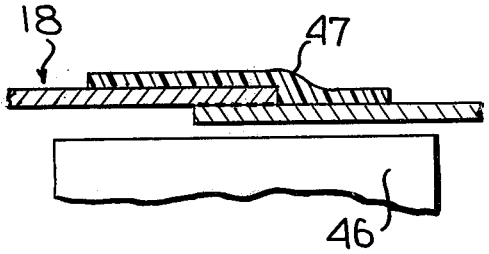
FIG.5
FIG.3
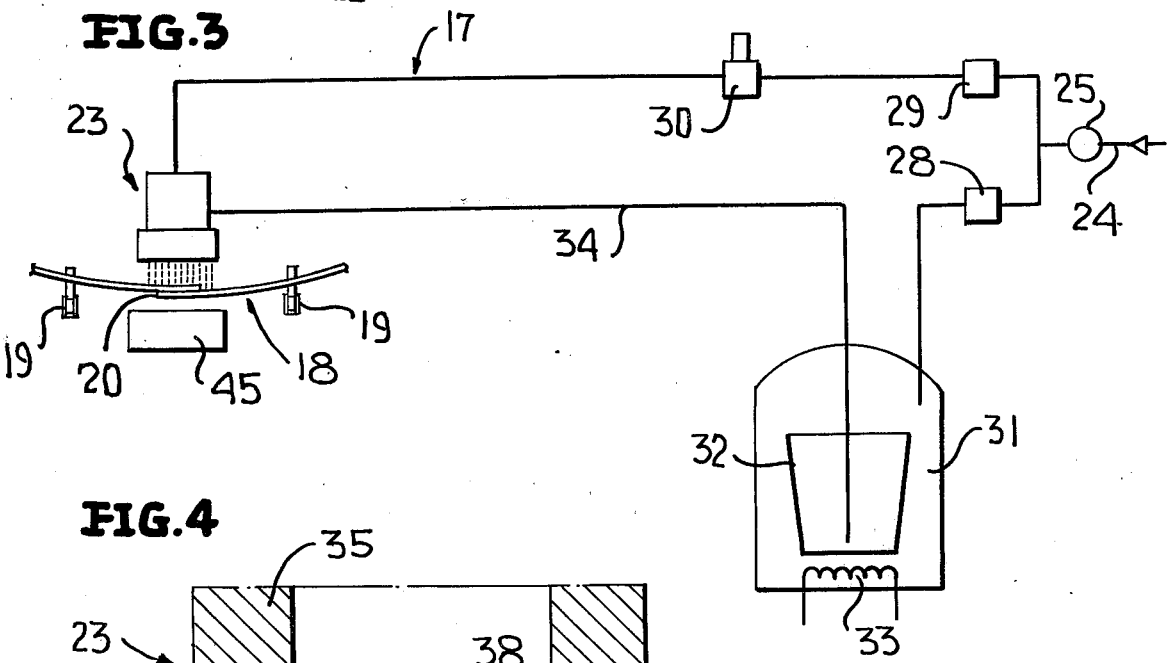
FIG.4
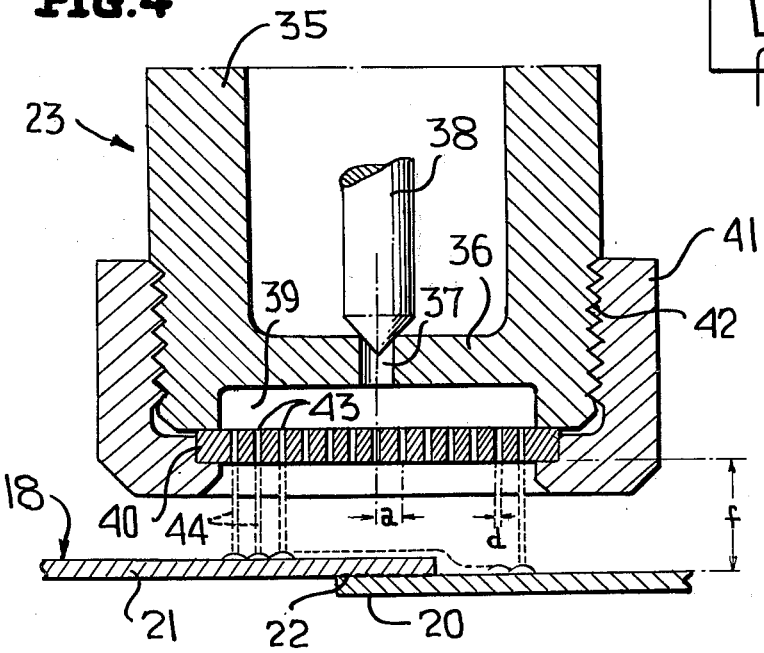

CONTAINER AND METHOD AND APPARATUS FOR THE COATING OF SAME

This application is a continuation-in-part of copending application Ser. No. 683,674, filed May 5, 1976, now abandoned.

This invention relates to new and useful improvements in the construction of containers such as cans, packing containers, buckets and the like. The container may be formed of tinplate, coated steel, aluminum and other metals, and also may be formed by laminating different materials including plastics materials and metal.

Usually containers of this general class have various regions which are particularly exposed to a chemical reaction, such as corrosion. For example, containers which include a container body having a longitudinal side seam formed by soldering or welding will be particularly exposed to a chemical reaction with the contents of the container as the normal protective coating on the material from which the container is formed has been subjected in the region of the side seam to influences during the formation of the seam which reduce its resistance to corrosion. In the same manner, other regions of containers may be damaged in the formation thereof and these regions are also exposed to a chemical reaction.

Numerous attempts have been made to protect the particularly exposed regions of containers. In conventional cans, for example, it has been proposed to cover the side seam with a strip of plastics material or aluminum without the use of conventional seam lacquers. Great efforts have been made, particularly in connection with cans formed of tinplate, to prevent a chemical reaction between the raw edges of the tinplate, which are not coated, resulting from the production of the can, and the contents of the can. With this particularly in mind, it has been proposed to form the side seam of such cans in a manner wherein the raw edges of the material face the interior of the can to the least possible extent.

The known methods of protecting particularly exposed regions of containers suffer from various disadvantages. Certain of the known methods have proved not to provide a sufficiently effective protection, while other methods have been relatively troublesome and expensive to carry into effect.

This invention has for its object the provision of a container in which the normally exposed regions are protected against chemical reaction in a particularly effective, simple and inexpensive manner. This object is achieved in a container by the application of a band of thixotropic lacquer applied to the region of the container which is particularly exposed to a chemical reaction.

Thixotropic or gel-forming lacquers and paints are known, and it is well known that they have the property that after application they spread on the surface to which they are applied only for a very limited period of time. This property is extensively utilized in the production of lacquers and paints which are easy to apply because, when applied in thick coats, they have only a very slight tendendy to form drops which will run on the painted or lacquered surface.

In accordance with this invention it has been found that this property of thixotropic lacquers can be advantageously utilized for the protection of exposed container regions, having in mind that a thixotropic lacquer, unlike similar lacquers previously used for coating containers, will not run away from the sharp edges of the metal or from irregularities in the container wall. Such sharp edges and irregularities in the container wall in the past have resulted in the surfaces being exposed to a chemical reaction with the surroundings, most particularly with the product packaged within the container.

It has been found that it is extremely easy, inexpensive and a quick operation to apply a band of thixotropic lacquer to the normally exposed regions of a container and as a result the protection of the previously exposed regions of a container can be effected at a very low cost. Thus, this mode of coating exposed areas of containers contributes to the reduction of the total cost of producing the container. Further, in addition to the cost saving, it has been found that the protection afforded by the coating of thixotropic lacquer is extremely effective.

One embodiment of a container according to this invention is in the form of a container body having a longitudinal side seam and the container is characteristic in that the band of applied thixotropic lacquer is disposed internally of the container body in a position wherein it completely covers and seals the longitudinal side seam. In this embodiment of the container an effective and inexpensive protection of the side seam is obtained with the side seam being that region in many types of containers which is normally exposed to a chemical reaction with the contents of the container.

This invention also relates to a method of producing a coating on a container of the type having a longitudinal side seam. The method is characterized in that in the region of the container which is particularly exposed to a chemical reaction, a band of thixotropic lacquer is applied by forcing this lacquer out through a nozzle in the form of a controlled stream or streams. The method provides a simple and inexpensive way of obtaining effective protection of most of the normally exposed regions of the container against a chemical reaction.

A characteristic feature of one embodiment of the method according to this invention is that the lacquer band is directed onto the container through two or more openings which are close to one another so that after the streams of lacquer are applied to the container, the streams flow into one another and unite into a coherent band. Utilizing this method, it has been found possible to apply a band of thixotropic lacquer of a width which in the past has been difficult to effect with a nozzle having only a single opening.

A further characteristic of the method of this invention is that selectively the container or the thixotropic lacquer immediately before being applied is heated to a temperature ranging between room temperature and the boiling point of a solvent of the lacquer. In this manner there is a reduced risk of formation of blisters in the lacquer band thereby providing for a more effective and assured protection of the container.

A further characteristic feature of the method of this invention is that immediately before being applied the thixotropic lacquer is heated to a temperature of about 50° C. This temperature has proved to be particularly expedient in avoiding blister formation in the band of applied lacquer.

In accordance with another feature of the method, a temperature is selected for the applied thixotropic lacquer which is corelated with the boiling point of that constituent of the lacquer having the highest boiling point, which boiling point is at least 165° C. By this means a reduced risk of blister formation in the applied lacquer band is effected with there being an increased effectiveness of the protection afforded by the applied lacquer band.

Further, it has been found that beneficial results can be obtained if after application the band of thixotropic lacquer is heated to a temperature on the order of 150°-220° C.

The invention further relates to an apparatus for effecting the coating of a container in accordance with the foregoing, the apparatus including a nozzle for spraying the thixotropic lacquer in closely spaced individual streams. The nozzle may have two or more adjacent openings for defining such lacquer streams with as many as fourteen openings having been found feasible.

One feature of the apparatus is that in advance of the nozzle there are arranged heating means for heating the lacquer to a preferred application temperature. Alternatively, the container area to be coated may be suitably heated prior to the application of the thixotropic lacquer.

A further feature of the apparatus of this invention is that downstream of the nozzle along the path of movement of the container being coated there is provided a heater for heating the container in the region of the applied band of lacquer with such heating of the container being effective to heat and cure the lacquer band.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is a fragmentary transverse sectional view taken through that portion of a container body having an interlocked side seam, with the side seam being protected by a band of thixotropic lacquer applied in a single stream.

FIG. 2 is a fragmentary transverse sectional view similar to FIG. 1, but showing a band of thixotropic lacquer applied in at least two separate streams.

FIG. 3 is a schematic view of the apparatus for applying a band of thixotropic lacquer to a container side seam initially in the form of plural separate streams, the apparatus including a nozzle.

FIG. 4 is an enlarged fragmentary sectional view through the lower portion of the nozzle of FIG. 3, and shows specifically the construction of the nozzle and the formation of a protective band of thixotropic lacquer by applying the lacquer in plural separate streams.

FIG. 5 is a fragmentary sectional view taken through the container after the application of the band of thixotropic lacquer, and shows the same being heated by a downstream heater.

Referring now to FIG. 1, it will be seen that there is illustrated a conventional container body 10 having a longitudinal side seam 11 of which at least a portion is of the lock type. It will be seen that the side seam 11 is formed from two remote edges of the container body blank 12 with these edges including an outer edge 13 and an inner edge 14. These edges are cut edges, and therefore present raw metal.

Most particularly, it is to be understood that the container body 10 is formed from a material which normally has a coating thereon, generally both internally and externally, which is resistant to corrosion. For example, in conventional tinplate, the blank 12 is formed of steel having a tin or other non-corrosive metal coating on the opposite faces thereof. On the other hand, a steel base may have suitable applied coatings on the inner and outer surfaces thereof, which coatings may be different. In all cases, when the body blank 12 is formed, the metal is sheared leaving an exposed newly formed raw edge which is not protectively coated and thus is subject to corrosion. Further, in the formation of the side seam 11, frequently the original coating is locally damaged by the tooling which effects such formation. While the side seam is normally the most troublesome area of a can body with respect to protection, it is to be understood that other areas of the can body may also be damaged or for other reasons may have insufficient protective coating.

It is to be understood that in the formation of the side seam 11, the raw edges 13 and 14 are confined as much as possible within the side seam. Further, a solder may be applied to the side seam which not only seals the side seam but also affords a degree of protection to the raw edges.

In accordance with this invention, with particular reference to the side seam 11, but not so limited, the portions of the container body which are normally exposed due to the absence of a proper protective coating, is covered by a band 15 of thixotropic lacquer with this lacquer at least partially flowing into the side seam 11.

It is to be understood that the thixotropic lacquer which is utilized in accordance with this invention may be any type of lacquer in which a suitable thixotropic agent can be incorporated. By way of example only, tests have been made with bi-component epoxy-polyamide and mono-component lacquers of the epoxy-ester type, vinyl type and phenol type.

The lacquer band 15 shown in FIG. 1 has an undesirable substantially circular cross section resulting from the application of the thixotropic lacquer in a single stream through a single relatively small aperture. The cross section of the band 15 is a result of the property of the thixotropic lacquer that after application the lacquer will spread to only a very slight extent. It has been found, and it is obvious that the cross sectional shape of the lacquer band resulting from the single stream application contains a much larger quantity of lacquer than that which is required effectively to protect the side seam 11.

In view of this undesirable waste of lacquer, it has been found that the thixotropic lacquer is applied through a nozzle with two or more openings which are close to one another. Although the thixotropic lacquer is applied in two or more separate streams, after it flows onto the surface of the container, it flows together to form a single band of lacquer, as is shown in FIG. 2, the band of lacquer being identified by the numeral 16. Comparing FIGS. 1 and 2, it will be seen that a materially less amount of lacquer is required in the band 16 to protect the same area.

Reference is now made to FIG. 3 wherein there is schematically illustrated an apparatus for applying the thixotropic lacquer in accordance with this invention, the apparatus generally being identified by the numeral 17. First of all, it is to be understood that a can body, such as the illustrated can body 18, will be conveyed in a conventional manner along a predetermined straight line path. Normally the can body 18 will be carried by a horn (not shown) and movement therealong may be effected by suitable conveyor means. However, for simplicity purposes, two endless conveyors 19, which are transversely spaced, have been shown.

At this time it is also pointed out that the can body 18 illustrated in FIGS. 3–5 differs from the can body 10 in that in lieu of the customary lap and lock soldered side seam illustrated in FIGS. 1 and 2, there is illustrated an overlap side seam 20 wherein the remote edges of the blank 21 from which the container body 18 is formed are disposed in overlapping relation and are secured together such as by welding 22, although other types of bonding means may be provided.

Referring once again to FIG. 3, it will be seen that the apparatus 17 includes a spray nozzle generally identified by the numeral 23. The spray nozzle 23 will be suitably supported within the confines of the path of a can body 18 being conveyed by the conveyors 19 and normally will be carried by the unillustrated horn.

In accordance with this invention, a compressed air line 24 will be directed into the apparatus with the flow therethrough being controlled by a valve 25. The supply line 24 is split downstream of the valve 25 into lines 26 and 27, with the lines having incorporated therein pressure reducing valves 28, 29, respectively. The pressure supplied by the line 24 is on the order of 6-7 bar, with the pressure supplied by the line 26 being on the order of 3-4 bar, and the pressure supplied by the line 27 being on the order of 4 bar.

The line 27 leads to the nozzle 23 and has incorporated therein a control valve 30 for controlling the actuation of the nozzle 23.

The line 26 leads into a pressure tank 31 in which a supply vessel 32 for the thixotropic lacquer is mounted. A suitable heater 33 is associated with the supply vessel 32 for heating the lacquer. A lacquer supply line 34 leads from the vessel 32 out of the pressure tank 31 to the nozzle 23.

Referring now to FIG. 4 in particular, it will be seen that the nozzle 23 includes a body 35 having the lower end thereof partially closed by a wall 36. The wall 36 has a lacquer supply opening 37 therethrough which, in turn, is controlled by an adjustable needle valve 38. The needle valve 38 will be positioned by means of a conventional actuator or positioner (not shown) which, in turn, is controlled by air pressure in the line 27 as controlled by the control valve 30.

The body 35 below the wall 36 defines a chamber 39 which is closed by an exchangeable nozzle plate 40. The nozzle plate is clamped to the underside of the body 35 by a nut 41 which is removably threadedly engaged with the exterior of the body 35 as at 42.

The nozzle plate 40 is provided with two or more openings 43 through which the thixotropic lacquer is pressed or forced in the form of separate streams 44. The openings 43 are preferably in the form of holes, but may be in the form of slots elongated in the direction of container body travel. The holes 43 may number as many as fourteen when the nozzle 23 is utilized for applying a band of thixotropic lacquer to cover a container body side seam.

The width of the holes 43 or in the case of circular holes the diameter of the holes will range from 0.3 to 1.0 mm. The spacing between centers of holes in a direction transversely of container body movement will range from 1.0 to 2.5 mm. Finally, the underside of the nozzle plate 40 will be spaced from the underlying outermost lap of the container body 18 a distance ranging from 5–10 mm.

When forming a band of thixotropic lacquer in accordance with this invention, steps must be taken to avoid the formation of blisters or bubbles during the application of the lacquer to the container body. The blisters or bubbles can be eliminated or substantially reduced by selectively heating the container or the lacquer immediately prior to the directing of the lacquer onto the container. Most specifically, the lacquer when applied or immediately thereafter should have a temperature generally ranging between room temperature and the boiling point of a solvent for the lacquer. The temperature is preferably on the order of 50° C.

There has already been shown in FIG. 3 a heater for the lacquer. Further, upstream of the nozzle 23 a suitable heater 45 may be provided for heating the container body in the side seam area.

The risk of blister formation can be further reduced by using a thixotropic lacquer having as a constituent a constituent having a maximum boiling point of at least 165° C.

It is of particular importance for the practical application of a thixotropic lacquer band in accordance with this invention that the band be made to dry or set in a relatively short time. This can be achieved by heating the lacquer band after application to a container body to a temperature of 150°–220° C. In order to accomplish this, the container body 18 may be heated downstream of the nozzle 23 by means of a downstream heater 46 as shown in FIG. 5. In FIG. 5, the band of thixotropic lacquer is identified by the numeral 47.

In the foregoing special embodiments of the invention have been particularly referred to. It should be noted, however, that the protection of particularly exposed container regions is not to be restricted to the longitudinal side seam of a container body, but any region of a container which is particularly exposed to a chemical reaction with the surrounding atmosphere or product may be protected in a similar manner. By way of example, it may be desirable to protect the container region in addition along the side seam, around the joint between the end closures of the container and the container body. Also, portions of the container may have incorporated therein opening means which in the formation thereof result in the undue damaging of the original protective coating of the metal from which the container is formed.

Although the container body illustrated in the drawings is of the type which is extensively used for cans, it is to be understood that the invention is also useful in connection with other types of containers including packing containers, buckets and the like.

Further, the invention is not restricted to containers formed of metal only, but may be utilized in connection with containers formed of other materials, including containers formed of laminated different materials.

Although only a preferred embodiment of the invention has been specifically illustrated and described herein, it is to be understood that minor variations may be made in the method of applying the thixotropic lacquer and the apparatus for carrying out that method without departing from the spirit and scope of the invention as defined by the appended claims.

We claim:

1. A method of coating a container surface which is particularly subjected to a chemical reaction and wherein the surface is of a nature wherein it is particularly difficult to obtain coating adherence, said method including the steps of providing a nozzle and forcing a stream of lacquer out of the nozzle onto the surface, the method being characterized in that the lacquer is a thixotropic lacquer.

2. The method of claim 1 wherein the lacquer is directed out of the nozzle towards a container side seam in a plurality of separate streams spaced apart transversely of the side seam but disposed closely adjacent one another with the streams flowing transversely of the side seam on the container surface and uniting in a coherent band.

3. The method of claim 2 wherein the container surface being coated is the interior of a longitudinal side seam, the nozzle is fixed, and the container is moved with the lacquer being applied forming a band extending along the side seam.

4. The method of claim 1 wherein said lacquer has a solvent with a boiling point and a selected one of the container surface and the lacquer is heated to a temperature between room temperature and the boiling point of the lacquer.

5. The method of claim 1 wherein the lacquer constitutes a plurality of components, and that one of said components having the highest boiling point having a boiling point of at least 165° C.

6. The method of claim 1 wherein the applied lacquer is heated to a temperature of 150°–220° C.

7. An apparatus for coating a container side seam, said apparatus comprising a nozzle, means for supplying a thixotropic lacquer to said nozzle under pressure, and said nozzle having means for delivering the thixotropic lacquer to a container side seam in at least two adjacent spaced apart separate streams, the spacing between said streams being within a range wherein the lacquer of the adjacent stream flows together to form a continuous band.

8. The apparatus of claim 7 together with conveyor means for conveying a container to be coated relative to said nozzle, and heater means downstream of said nozzle for heating the applied lacquer to a temperature of 150°–220° C.

9. The apparatus of claim 7 wherein said means for delivering a thixotropic lacquer includes a nozzle plate having separate holes therein, one for each stream, and said holes have a center-to-center spacing on the order of 1.0 to 2.5 mm.

10. The apparatus of claim 7 wherein said means for delivering a thixotropic lacquer includes a nozzle plate having separate holes therein, one for each stream, and said holes have a center-to-center spacing on the order of 1.0 to 2.5 mm. and a width on the order of 0.3 to 1.0 mm.

11. The apparatus of claim 7 wherein said means for delivering a thixotropic lacquer includes a nozzle plate having separate holes therein, one for each stream, and said holes have a center-to-center spacing on the order of 1.0 to 2.5 mm., and said holes range in number from 2 to 14.

12. The apparatus of claim 7 together with means for conveying a container along a predetermined path, said means for delivering thixotropic lacquer include a nozzle plate having separate holes therein, one for each stream, and said nozzle plate is spaced from said container path a distance on the order of 5 to 10 mm.

* * * * *